US011486122B2

(12) United States Patent
Kawazu et al.

(10) Patent No.: US 11,486,122 B2
(45) Date of Patent: Nov. 1, 2022

(54) FLUSH TOILET

(71) Applicant: TOTO LTD., Kitakyushu (JP)

(72) Inventors: Yukari Kawazu, Kitakyushu (JP); Toshiro Umeno, Kitakyushu (JP); Shu Kashirajima, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 17 days.

(21) Appl. No.: 17/025,776

(22) Filed: Sep. 18, 2020

(65) Prior Publication Data

US 2021/0095450 A1 Apr. 1, 2021

(30) Foreign Application Priority Data

Sep. 27, 2019 (JP) ..... JP2019-177892

(51) Int. Cl.
*E03D 1/26* (2006.01)
*E03D 9/08* (2006.01)
*E03D 5/01* (2006.01)

(52) U.S. Cl.
CPC ..... *E03D 1/26* (2013.01); *E03D 5/01* (2013.01); *E03D 9/08* (2013.01)

(58) Field of Classification Search
CPC ..... E03D 1/26; E03D 5/01; E03D 9/08
USPC ..... 4/332
See application file for complete search history.

(56) References Cited

U.S. PATENT DOCUMENTS

2013/0291297 A1* 11/2013 Kitamura ..... E03D 5/10 4/422
2017/0089052 A1* 3/2017 Ishimaru ..... E03D 11/08

FOREIGN PATENT DOCUMENTS

| | | | |
|---|---|---|---|
| CN | 108018923 | A | 5/2018 |
| JP | 1-116127 | A | 5/1989 |
| JP | 2008-106595 | A | 5/2008 |
| JP | 2017-66759 | A | 4/2017 |
| JP | 2017-218789 | A | 12/2017 |

OTHER PUBLICATIONS

Notice of Reasons for Refusal issued in Japanese Patent Application No. 2019-177892 dated Sep. 13, 2021, with English translation.

* cited by examiner

*Primary Examiner* — Christine J Skubinna
(74) *Attorney, Agent, or Firm* — BakerHostetler

(57) ABSTRACT

A flush toilet includes a toilet main body, a tank device provided behind the toilet main body, and a private part washing device configured to wash a private part of a user, the private part washing device being provided on a rear upper surface of the toilet main body behind the bowl. The tank device includes a water supply part configured to supply flush water supplied from a water supply source, a storage tank for storing the flush water supplied from the water supply part, the storage tank being located behind the private part washing device and above a floor surface, a pump configured to feed the flush water in the storage tank to the toilet main body, and a controller configured to control operation of the water supply part and the pump, and the controller is disposed on an outer upper surface of the storage tank.

7 Claims, 6 Drawing Sheets

FLUSH TOILET

CROSS-REFERENCE TO RELATED APPLICATION

This application claims benefit of priority to Japanese Patent Application No. 2019-177892, filed Sep. 27, 2019, the entire content of which is incorporated herein by reference.

BACKGROUND

Technical Field

The present disclosure relates to a flush toilet, and more particularly, to a flush toilet for flushing and discharging waste with flush water.

Background Art

Conventionally, as a flush toilet for flushing and discharging waste with flush water, one including a storage tank for storing flush water to be supplied to a toilet main body, and a private part washing device for washing private parts of a person using the toilet is known, as disclosed in Patent Document 1 (Japanese Patent Laid-Open No. 1-116127), for example.

With such a conventional flush toilet, the private part washing device is disposed on the toilet main body, on an upper surface behind a bowl, and the storage tank is disposed behind the private part washing device, and the storage tank and the private part washing device are thus each incorporated behind the toilet main body.

In recent years, there is a problem of how to achieve a so-called "low silhouette", which is achieved by designing the entire flush toilet so that the upper end height is reduced as much as possible, so as to attain better designs and a wider range of designs regarding flush toilets.

Accordingly, there is a problem of how to secure an appropriate tank capacity for flushing the toilet while achieving a low-silhouette toilet.

Moreover, functional units of a water supply system for supplying water to the storage tank and the private part washing device, related appliances, and an electronic appliance, such as a controller, for controlling such units and appliances may be provided around the storage tank of a flush toilet.

Accordingly, in the case of achieving a low-silhouette toilet by installing the storage tank behind the toilet main body, an installation space for the storage tank and the private part washing device behind the toilet main body, and peripheral appliances is a limited space between the toilet main body and an external wall surface behind the toilet main body (a wall surface of a toilet installation place).

Accordingly, one important object is to secure a tank capacity while effectively using the limited installation space behind the toilet main body.

Moreover, especially in relation to the controller for controlling the functional units of the water supply system for supplying water to the storage tank and the private part washing device, because electronic components are built in, durability against an excessive weight load and the like from outside is low, and also, resistance against water such as water leaking from the storage tank side or the toilet main body side is low.

Accordingly, securing reliability of the controller against external loads such as the excessive weight load and water is one important object.

Accordingly, the present disclosure provides a flush toilet, an overall size of which can be reduced while securing a tank capacity and reliability of whose controller can be secured.

SUMMARY

To solve the problems described above, the present disclosure is a flush toilet for discharging waste by flushing the flush toilet with flush water, the flush toilet comprising: a toilet main body including a bowl configured to receive waste, a rim formed on a top edge of the bowl, and a discharge trap configured to discharge the waste in the bowl; a tank device configured to supply flush water to the toilet main body, the tank device being provided behind the toilet main body; and a private part washing device configured to wash a private part of a user, the private part washing device being provided on a rear upper surface, of the toilet main body, behind the bowl, wherein the tank device includes a water supply part configured to supply flush water that is supplied from a water supply source, a storage tank configured to store the flush water supplied from the water supply part, the storage tank being located behind the private part washing device and above a floor surface, a pump configured to feed the flush water in the storage tank to the toilet main body, and a controller configured to control operation of the water supply part and the pump, and the controller is disposed on an outer upper surface of the storage tank.

According to the flush toilet described above, because the controller is disposed on the outer upper surface of the storage tank behind the toilet main body, a limited space behind the toilet main body, above the storage tank (an installation space, a dead space or the like), may be effectively used.

Accordingly, a dimension of the entire flush toilet in a front-back direction and a left-right direction may be reduced and the size of the flush toilet may be reduced while securing a capacity of the storage tank of the tank device.

Furthermore, because the controller is disposed on the outer upper surface, of the storage tank, blocking top of the storage tank, the controller may be prevented from getting wet from flush water in the storage tank.

Moreover, because the controller is disposed on the outer upper surface of the storage tank, the controller is disposed at a position relatively higher than the entire tank device. Accordingly, an excessive weight load may be prevented from being applied to the controller from the entire tank device.

As a result, reliability of the controller may be secured.

Furthermore, the controller above the storage tank may be easily accessed from above at the time of maintenance or the like of the tank device, and the ease of work may be increased.

In the present disclosure, preferably, an upper surface of the controller is located at a position higher than an upper surface of the rim of the toilet main body.

According to the flush toilet described above, the upper surface of the controller is located at a position higher than the upper surface of the rim of the toilet main body, and thus, even if flush water splashes from the bowl of the toilet main body onto the upper surface of the rim, the risk of the entire controller getting wet from the splashed flush water may be reduced. Accordingly, reliability of the controller may be further increased.

Furthermore, the controller above the storage tank may be easily accessed from above at the time of maintenance or the like, and the ease of work may be increased.

In the present disclosure, preferably, there are further included a private part washing device configured to wash a private part of a user, and a holding member configured to hold the private part washing device, the holding member being disposed behind the bowl and on the rear upper surface of the toilet main body, wherein the holding member includes a front base above which a private part washing-side housing region for housing a functional unit of the private part washing device is formed, and a rear base below which a tank-side housing region for housing the storage tank is formed, the rear base being provided behind the front base, and in the rear side base, a part configured to surround a periphery of the controller protrudes on a side of the private part washing-side housing region higher than a base surface of the front base so that the controller is housed in the tank-side housing region.

According to the flush toilet described above, the part, of the rear base of the holding member for holding the private part washing device, surrounding the periphery of the controller protrudes higher, on the side of the tank-side housing region, than the base surface of the front base, and thus, the controller may be housed in the tank-side housing region while effectively using the limited dead space behind the toilet main body, above the storage tank.

Furthermore, because the periphery of the controller may be covered by the rear base of the holding member, the controller may be effectively prevented by the rear base of the holding member from getting wet from water leaking from the toilet main body or the private part washing device, for example, even when the controller that is disposed on the outer upper surface of the storage tank protrudes higher (to the private part washing-side housing region side) than the base surface of the front base of the holding member.

Moreover, because the controller is provided above the storage tank and is protected by the rear base of the holding member, the controller may be protected from external loads such as water, an excessive weight load from outside and the like, and reliability of the controller may be further increased.

In the present disclosure, preferably, the discharge trap extends, in a plan view, in a front-back direction from an inlet connected to the bowl to an outlet behind the bowl, and the storage tank is disposed in a manner surrounding an upper part of the discharge trap from both left and right sides and from behind.

According to the flush toilet described above, because the storage tank is disposed in a manner surrounding the upper part of the discharge trap from both the left and right sides and from behind, the storage tank may be disposed by effectively using the limited space behind the toilet main body.

Accordingly, the size of the entire flush toilet may be reduced while securing a larger tank capacity.

In the present disclosure, preferably, the storage tank has a left-right asymmetrical shape including a large tank section and a small tank section, the large tank section being a large-capacity side of the storage tank that is divided into two at a center in a left-right direction, the small tank section being a small-capacity side of the storage tank that is divided into two at the center in the left-right direction.

According to the flush toilet described above, the storage tank has a left-right asymmetrical shape by including the large tank section and the small tank section, and thus, the storage tank for which a larger tank capacity may be secured may be disposed by effectively using the limited space behind the toilet main body.

In the present disclosure, preferably, the large tank section includes a rear large tank section disposed behind the discharge trap, a front large tank section that extends forward from the rear large tank section and that is disposed on one of left and right sides of the discharge trap, and a lower large tank section extending downward from the rear large tank section, the small tank section includes a rear small tank section disposed behind the discharge trap, and a front small tank section that extends forward from the rear small tank section and that is disposed on another one of the left and right sides of the discharge trap, a front end of the front large tank section is disposed more forward than a front end of the front small tank section, a bottom surface of the lower large tank section is located at a position that is lower than a bottom surface of each of the rear small tank section and the front small tank section, and the controller is provided on an outer upper surface of the rear large tank section and/or an outer upper surface of the rear small tank section.

According to the flush toilet described above, because the storage tank has a left-right asymmetrical shape due to the rear large tank section, the front large tank section and the lower large tank section of the large tank section and the rear small tank section and the front small tank section of the small tank section, a larger tank capacity may be secured by effectively using the limited space behind the toilet main body, and also, the size of the entire flush toilet may be reduced.

Furthermore, because the controller is provided on the outer upper surface of the rear large tank section and/or the outer upper surface of the rear small tank section of the storage tank, the risk of the entire controller getting wet may be reduced.

Moreover, the controller on the outer upper surface of the rear large tank section and/or the outer upper surface of the rear small tank section of the storage tank may be easily accessed from above at the time of maintenance or the like, and the ease of work may be further increased.

In the present disclosure, preferably, the controller is configured to control so as to drive the pump while water is being supplied from the water supply part to the storage tank.

According to the flush toilet described above, the pump may be driven under control of the controller while water is being supplied from the water supply part to the storage tank, and flush water may be fed under pressure from the storage tank to the toilet main body, and supply of water from the water supply part to the storage tank and supply of flush water by the pump to the toilet main body may be simultaneously performed.

This may reduce the risk of a water level in the storage tank rapidly rising and causing overflow of water during water supply, even if the tank capacity is limited because the storage tank is disposed in the limited space behind the toilet main body.

With the flush toilet of the present disclosure, the overall size of the flush toilet can be reduced while securing a tank capacity, and also, reliability of the controller may be secured.

DETAILED DESCRIPTION

Hereinafter, a flush toilet according to an embodiment of the present disclosure will be described with reference to the appended drawings.

Figure 1:
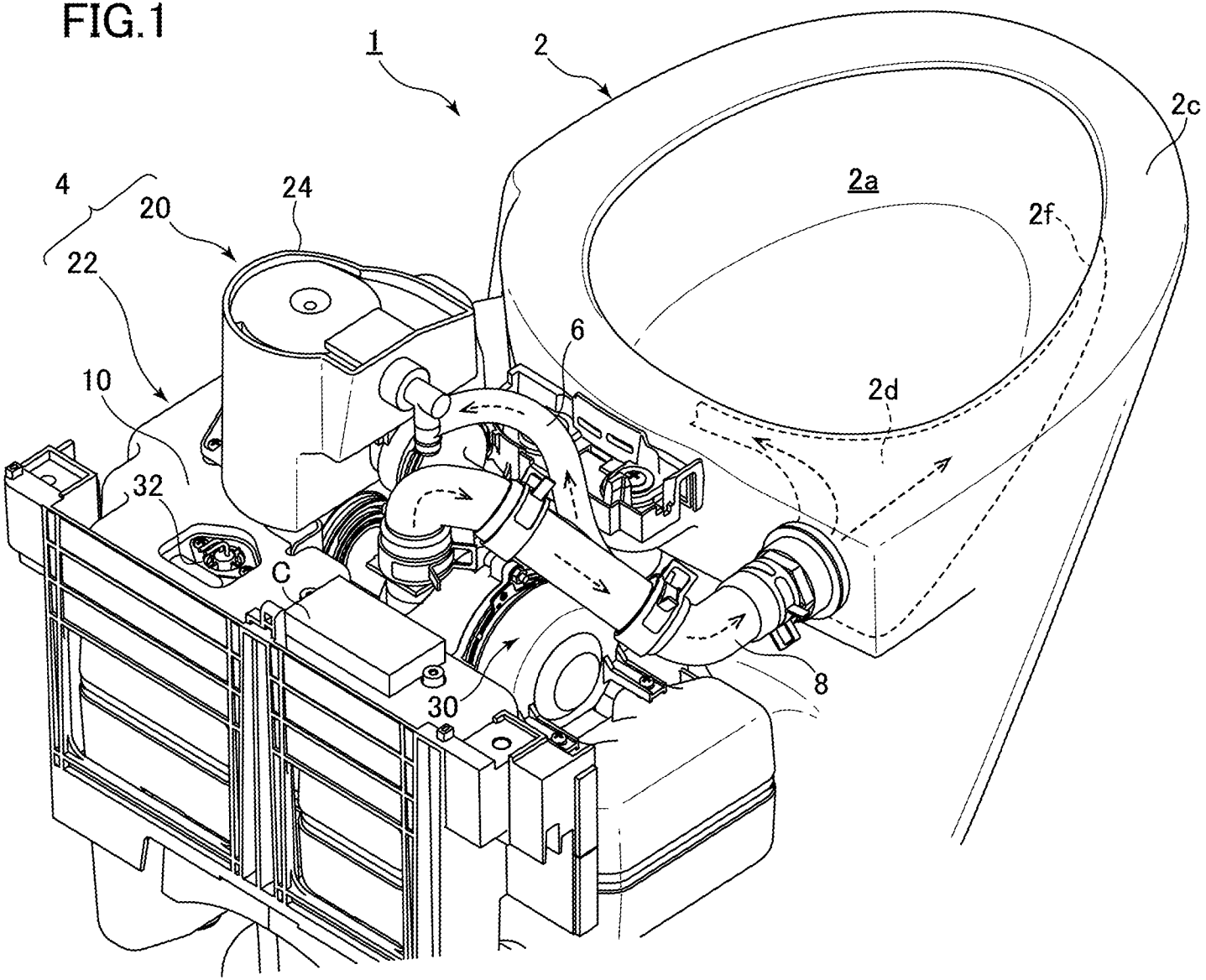
FIG. 1 is a schematic perspective view showing a flush toilet according to an embodiment of the present disclosure, where the flush toilet is seen obliquely from behind and above.

First, FIG. 1 is a schematic perspective view showing the flush toilet according to the embodiment of the present disclosure, where the flush toilet is seen obliquely from behind and above. Furthermore, FIG. 2 is an overall configuration diagram of the flush toilet according to the embodiment of the present disclosure.

Figure 2:
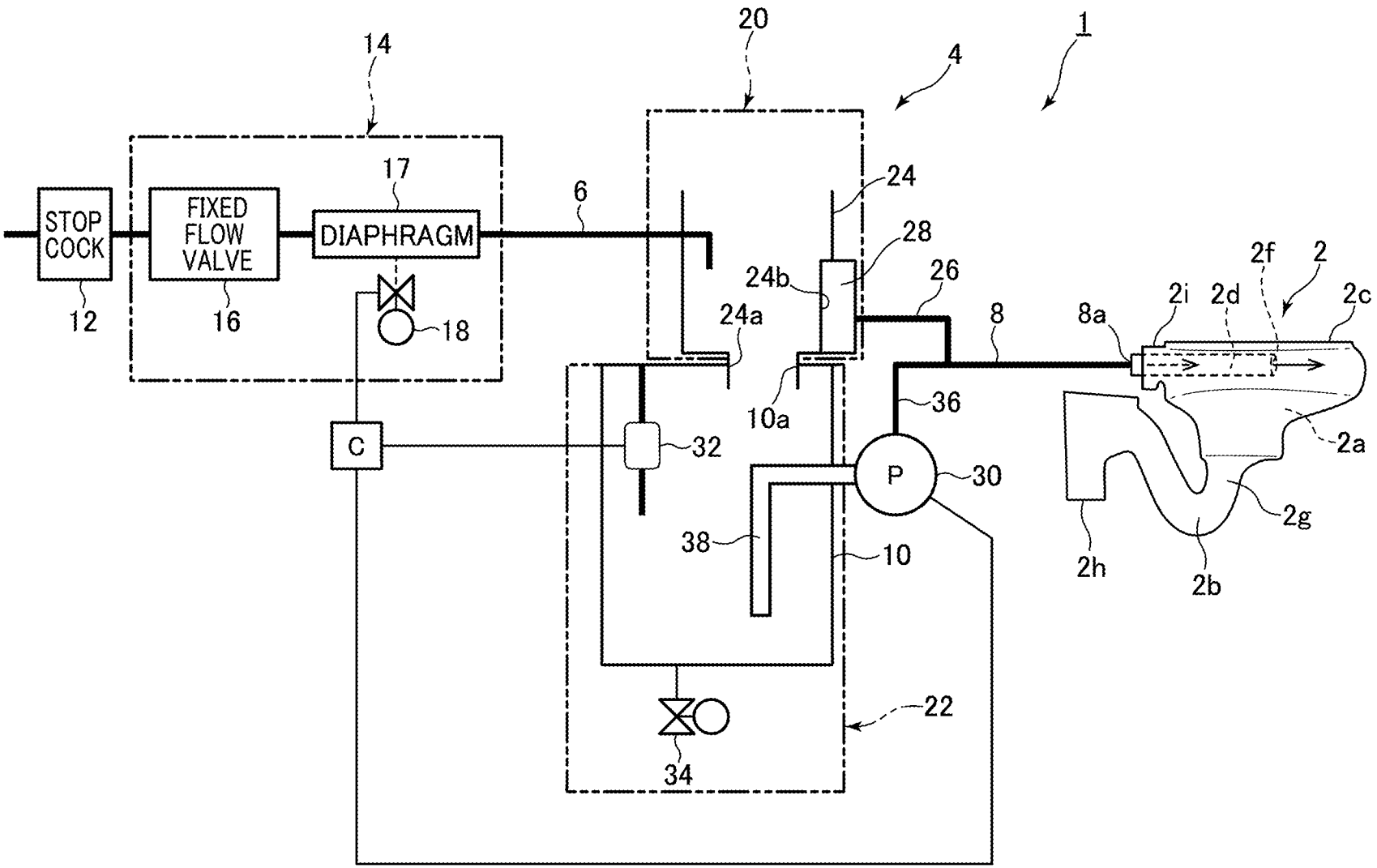
FIG. 2 is an overall configuration diagram of the flush toilet according to the embodiment of the present disclosure.

As shown in FIGS. 1 and 2, a flush toilet 1 according to the embodiment of the present disclosure includes a toilet main body 2 made of ceramics, and a tank device 4 that is provided behind the toilet main body 2.

Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim 2*c* formed at a top edge of the bowl 2*a*.

Next, as shown in FIGS. 1 and 2, the tank device 4 includes a water supply pipe 6 (a water supply part) and a water discharge pipe 8 that are connected, respectively, on an upstream side and a downstream side of the tank device 4.

An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10.

Furthermore, a stop cock 12 and a valve unit 14 are provided on the water supply pipe 6, from the upstream side to the downstream side.

Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10.

At the valve unit 14, a flow rate of flush water in the water supply pipe 6 is adjusted to be constant by the fixed flow valve 16.

Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20.

That is, the valve unit 14 as a whole functions, together with the water supply pipe 6, as a water supply part that supplies flush water that is supplied from a water supply source such as a water system to the storage tank 10.

As shown in FIG. 2, the connecting unit 20 includes a water receiving housing 24, an overflow pipe 26, and a check valve 28.

Moreover, a lower opening 24*a* of the water receiving housing 24 is detachably connected to an upper opening 10*a* of the storage tank 10 of the tank unit 22.

The overflow pipe 26 connects an overflow port 24*b* provided in a part of a side wall of the water receiving housing 24 and the water discharge pipe 8.

The water discharge pipe 8 is a connecting pipe (a flush water supply pipe), an upstream side of the water discharge pipe 8 is connected to a pump 30 of the tank device 4, and a downstream side of the water discharge pipe 8 is connected to a rim conduit 2*d* inside the rim 2*c* of the toilet main body 2.

Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

Next, as shown in FIG. 2, the tank unit 22 includes the storage tank 10, the pump 30, a float switch 32, a drain plug 34, a controller C and the like.

The pump 30 is provided on a part (midstream) of a water passage pipe 36 connected on an upstream side of the water discharge pipe 8. An upstream end 36*a* of the water passage pipe 36 is connected to a downstream end 38*a* of a suction pipe 38 provided in the storage tank 10.

Flush water stored in the storage tank 10 is suctioned from the suction pipe 38 into the water passage pipe 36 by operation of the pump 30, and is then fed under pressure to the water discharge pipe 8 via the pump 30.

All the flush water that is supplied from the storage tank 10 to the water discharge pipe 8 by the pump 30 is thus supplied into the rim conduit 2*d* from an inlet 2*e* of the rim conduit 2*d*.

Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed.

That is, the water passage pipe 36 and the water discharge pipe 8 each function as a flush water supply pipe for supplying flush water that is fed under pressure from the storage tank 10 by the pump 30 to the toilet main body 2.

The float switch 32 detects a water level inside the storage tank 10. An opening/closing operation of the electromagnetic valve 18 of the valve unit 14 is controlled by the controller C based on the water level inside the storage tank 10 that is detected by the float switch 32.

Furthermore, the operation of the pump 30 is also controlled by the controller C based on the water level inside the storage tank 10 that is detected by the float switch 32.

For example, in the case where the water level inside the storage tank 10 that is detected by the float switch 32 is at or below a predetermined water level, the electromagnetic valve 18 is opened, the water supply pipe 6 is released, and the pump 30 is caused to operate.

Then, when the water level inside the storage tank 10 reaches the predetermined water level, the electromagnetic valve 18 is closed, the water supply pipe 6 is closed, and the pump 30 is stopped.

Furthermore, the pump 30 may be controlled and driven by the controller C while water is being supplied from the water supply pipe 6 to the storage tank 10, and flush water may be fed under pressure from the storage tank 10 to the toilet main body 2, and supply of water from the water supply pipe 6 to the storage tank 10 and supply of flush water by the pump 30 to the toilet main body 2 may be simultaneously performed.

Additionally, arrangement of the controller C in the tank device 4 will be described later in detail.

The drain plug 34 is provided in a bottom surface of the storage tank 10. In normal use, the drain plug 34 is closed at all times, and the drain plug 34 can be removed as necessary to discharge the flush water in the storage tank 10 to outside.

Next, details of the storage tank 10 of the tank unit 22 will be given with reference to FIGS. 3 to 6.

Figure 3:
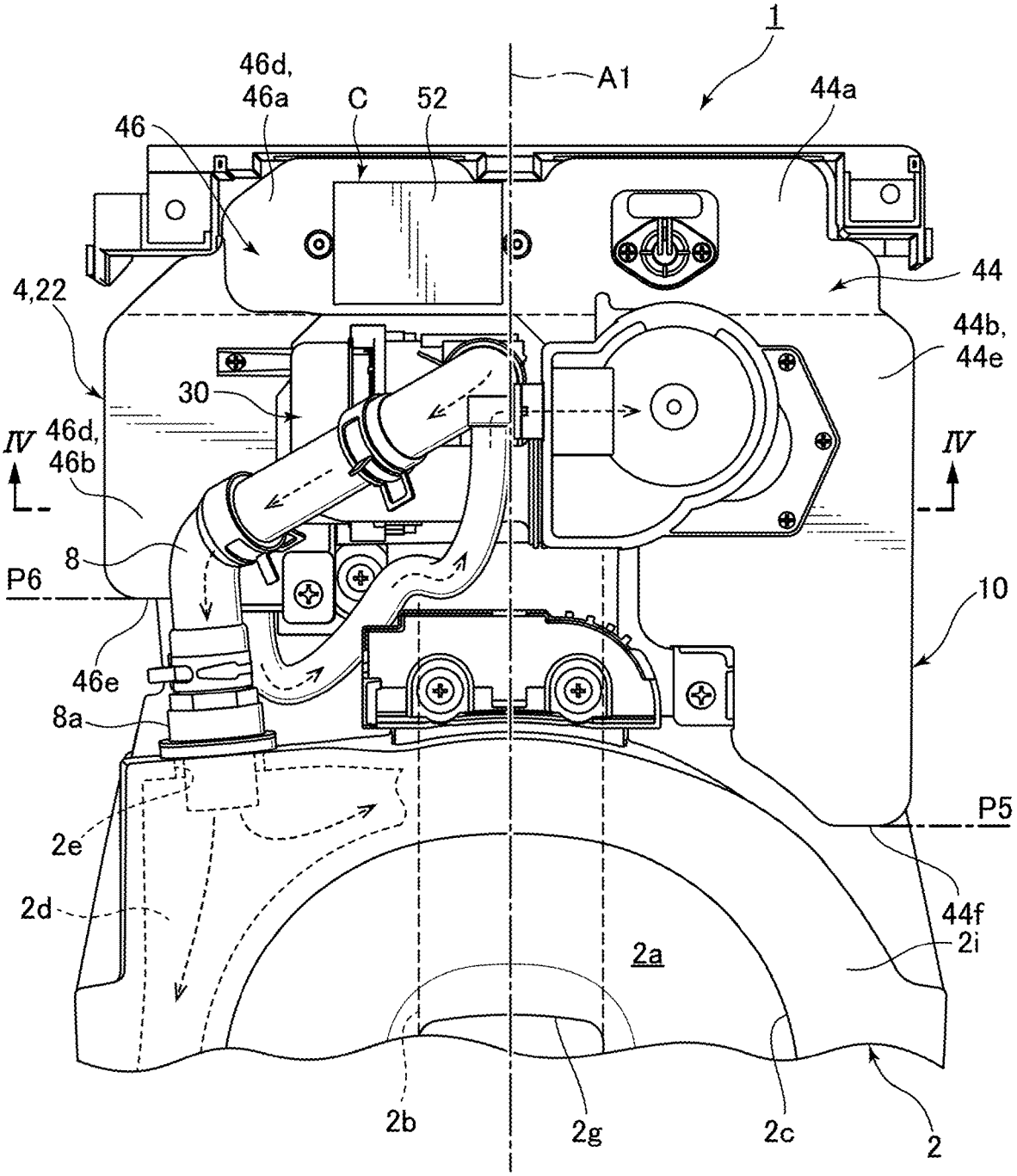
FIG. 3 is an enlarged partial plan view showing a part of the flush toilet according to the embodiment of the present disclosure in an enlarged manner, the part corresponding to a tank unit.

FIG. 3 is an enlarged partial plan view showing a part of the flush toilet according to the embodiment of the present disclosure in an enlarged manner, the part corresponding to the tank unit. Furthermore, FIG. 4 is a cross-sectional view taken along a line IV-IV in FIG. 3.

Figure 4:
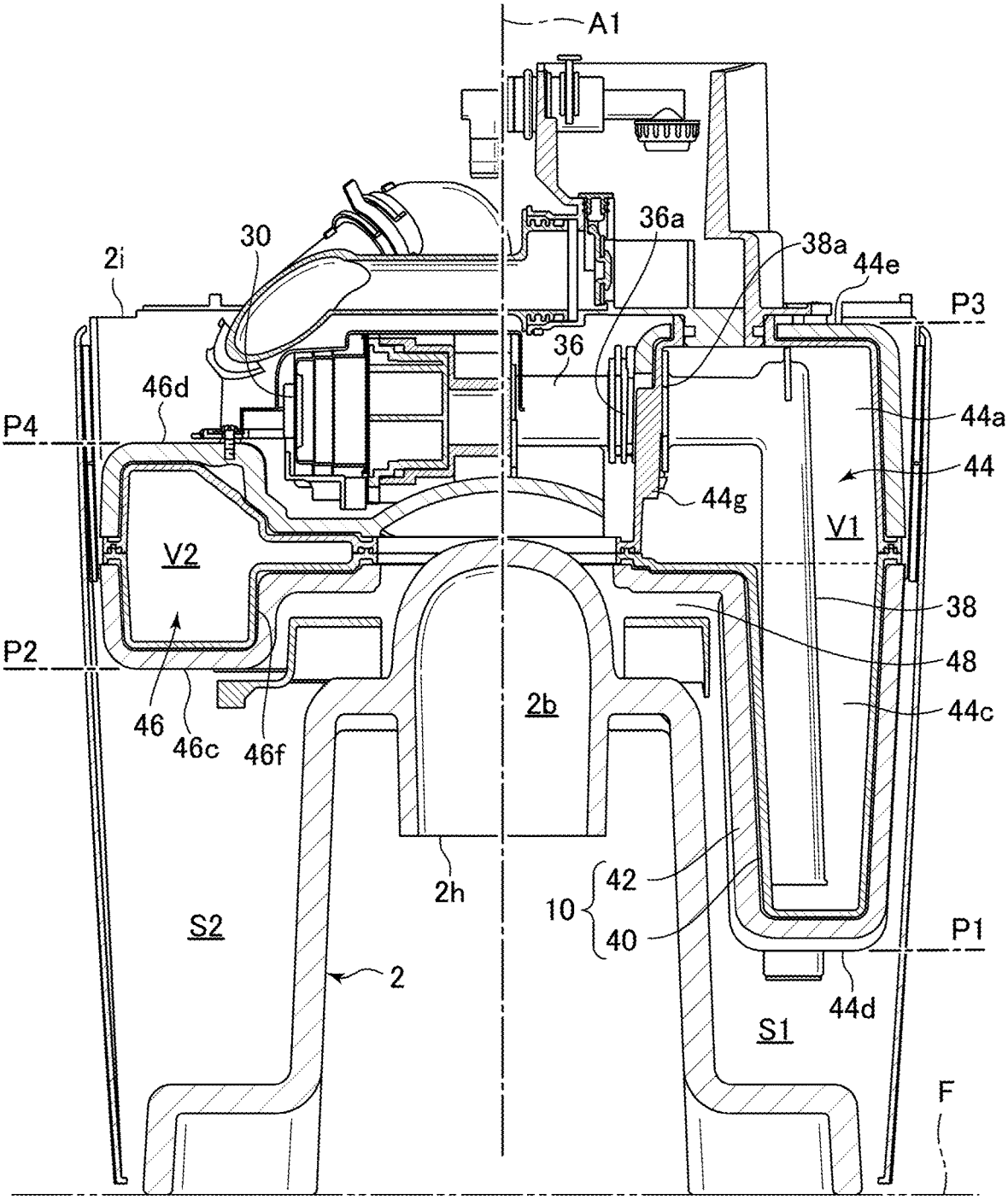
FIG. 4 is a cross-sectional view taken along a line IV-IV in FIG. 3.

First, as shown in FIGS. 3 and 4, the storage tank 10 of the tank unit 22 includes a single tank main body 40, and an antisweat material 42 covering an outside of the tank main body 40.

Figure 5:
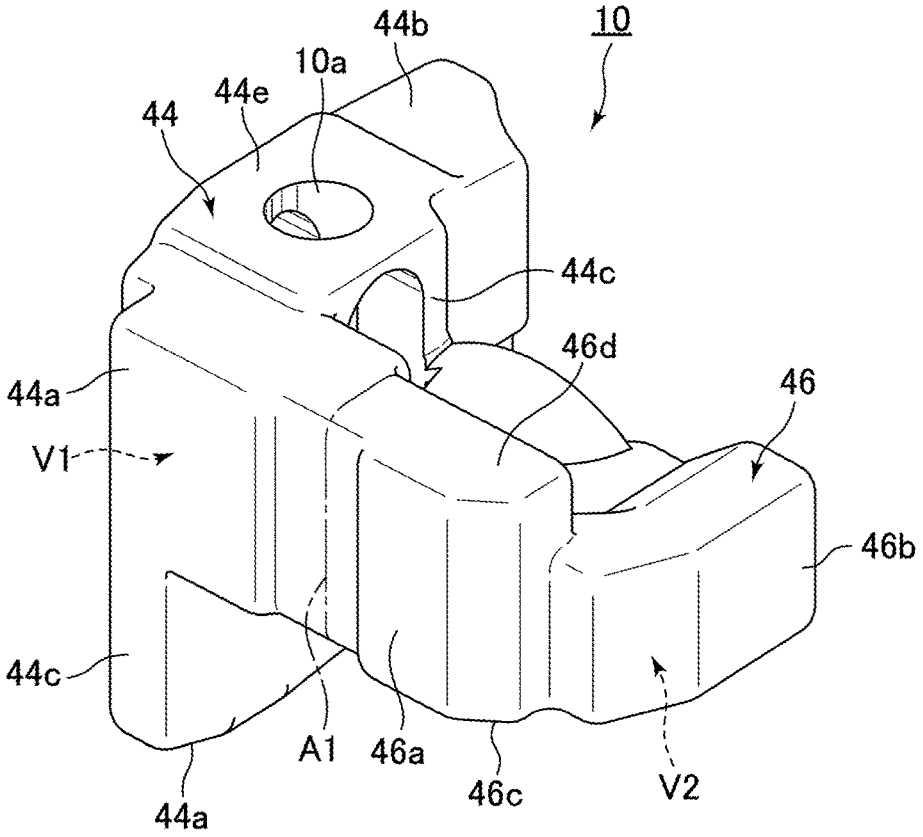
FIG. 5 is a perspective view showing a storage tank of the flush toilet according to the embodiment of the present disclosure, where the storage tank is seen obliquely from behind and above.

Next, FIG. 5 is a perspective view showing the storage tank of the flush toilet according to the embodiment of the present disclosure, where the storage tank is seen obliquely from behind and above. Furthermore, FIG. 6 is a rear view of the storage tank of the flush toilet according to the embodiment of the present disclosure.

As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46.

Figure 6:
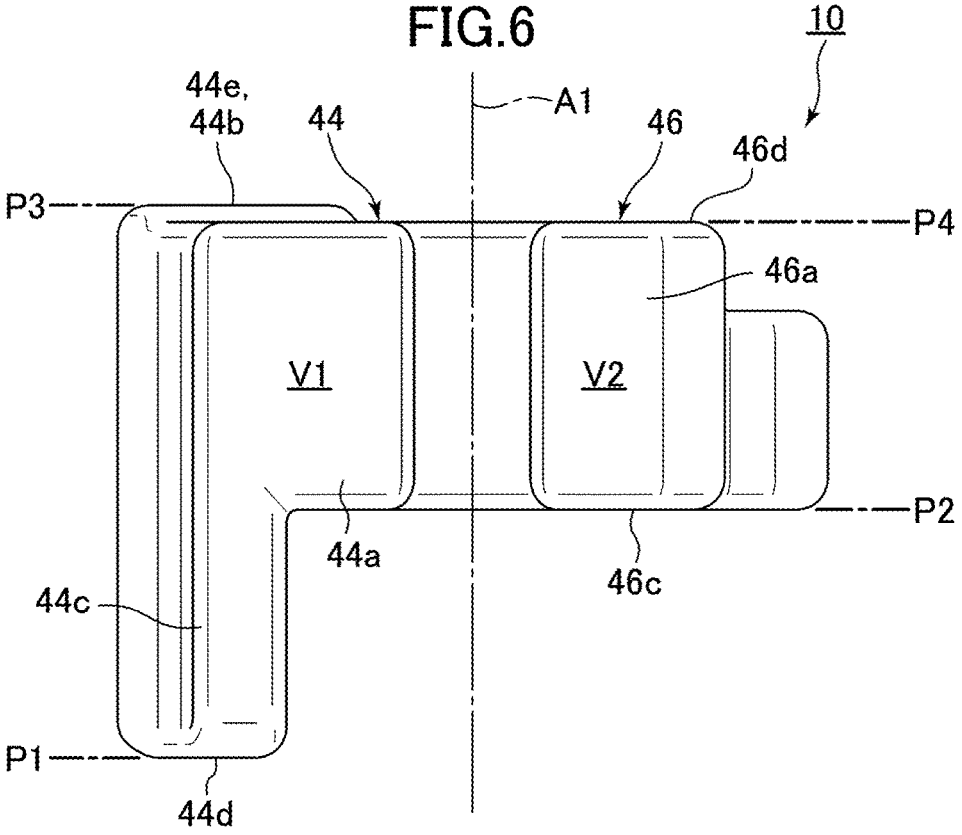
FIG. 6 is a rear view of the storage tank of the flush toilet according to the embodiment of the present disclosure.

That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 is disposed on a right side of the vertical plane A1, and a capacity V1 of the large tank section 44 is set greater than a capacity V2 of the small tank section 46 (V1>V2).

Accordingly, because of the large tank section 44 and the small tank section 46, the storage tank 10 has a left-right asymmetrical shape (a deformed shape of an approximately C-shape or U-shape in a plan view).

Furthermore, as shown in FIGS. 1, 3 and 4, the discharge trap pipe 2*b* of the toilet main body 2 extends in a front-back direction from an inlet 2*g* connected to a lower part of the bowl 2*a* to an outlet 2*h* behind the bowl 2*a*.

Furthermore, as shown in FIGS. 3 to 6, the large tank section 44 of the storage tank 10 includes a rear large tank section 44*a* disposed behind the discharge trap pipe 2*b*, a front large tank section 44*b* extending forward from the rear large tank section 44*a* while being disposed on one of left and right sides of the discharge trap pipe 2*b* (the right side when the toilet main body 2 is seen from front), and a lower large tank section 44*c* extending downward from the rear large tank section 44*a*.

Next, as shown in FIGS. 3 to 6, the small tank section 46 of the storage tank 10 includes a rear small tank section 46*a* disposed behind the discharge trap pipe 2*b*, and a front small tank section 46*b* extending forward from the rear small tank section 46*a* while being disposed on the other of the left and right sides of the discharge trap pipe 2*b* (the left side when the toilet main body 2 is seen from the front).

That is, as shown in FIGS. 1, 3 and 4, the storage tank 10 is disposed in a manner surrounding an upper part of the discharge trap pipe 2*b* from both the left and right sides and from behind.

Next, as shown in FIG. 4, the toilet main body 2 includes, in a region behind the bowl 2*a*, a large-tank housing section S1 and a small-tank housing section S2 for housing the large tank section 44 and the small tank section 46, respectively, at a position higher than a floor surface.

That is, in the region behind the bowl 2*a* of the toilet main body 2, the large-tank housing section S1 is formed on one of left and right sides of the vertical plane A1 that divides the region into two in the left-right direction (on the right side of the vertical plane A1 when the toilet main body 2 is seen from front).

In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position of a bottom surface of the large tank section 44 (a lowest position P1 of a bottom surface 44*d* of the lower large tank section 44*c*) is located at a position lower than a lowest position of a bottom surface of the small tank section 46 (a lowest position P2 of a bottom surface 46*c* of the rear small tank section 46*a* and the front small tank section 46*b*).

Furthermore, as shown in FIGS. 4 to 6, in the state where the large tank section 44 and the small tank section 46 are disposed in the large-tank housing section S1 and the small-tank housing section S2, respectively, a highest position of an upper surface of the large tank section 44 (a highest position P3 of an upper surface 44*e* of the front large tank section 44*b*) is located at a position higher than a highest position P4 of an upper surface 46*d* of the rear small tank section 46*a* and the front small tank section 46*b* of the small tank section 46 and lower than an upper surface 2*i* of the rim 2*c* of the toilet main body 2.

Furthermore, as shown in FIGS. 3 to 6, a position P5 of a front end 44*f* of the front large tank section 44*b* is positioned more forward than a position P6 of a front end 46*e* of the front small tank section 46*b*.

As shown in FIGS. 2 and 4, the suction pipe 38 is provided extending inside both the rear large tank section 44*a* and the lower large tank section 44*c* of the large tank section 44 of the tank main body 40. Furthermore, the upstream end 36*a* of the water passage pipe 36 extending on an upstream side (sideways) from the pump 30 is connected to the downstream end 38*a* of the suction pipe 38, that is a part of the large tank section 44, in a watertight manner.

Furthermore, as shown in FIG. 3, an upstream end of the water discharge pipe 8 is connected to a downstream end of the water passage pipe 36 extending on a downstream side (upward) from the pump 30, and a downstream end (an outlet 8*a*) of the water discharge pipe 8 is connected to the inlet 2*e* of the rim conduit 2*d* on the other one of the left and right sides of the vertical plane A1 of the toilet main body 2 (on the left side of the vertical plane A1 when the toilet main body 2 is seen from the front).

Next, as shown in FIG. 4, a side wall surface 44*g* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front).

Likewise, a side wall surface 46*f* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front).

Furthermore, as shown in FIGS. 4 and 5, the discharge trap pipe 2*b* is provided at the center of the toilet main body 2 in the left-right direction, and the upstream end 36*a* of the water passage pipe 36 is connected to the side wall surface 44*g* that is the side surface, of the large tank section 44, on the discharge trap pipe 2*b* side, of left and right side surfaces of the large tank section 44.

Furthermore, as shown in FIGS. 3 and 4, the pump 30 is disposed behind the bowl 2*a* of the toilet main body 2, at a position higher than the discharge trap pipe 2*b*.

Moreover, the pump 30 is disposed more forward than the rear large tank section 44*a* and the rear small tank section 46*a*, and in a space between the front large tank section 44*b* and the front small tank section 46*b* in the left-right direction.

Accordingly, the pump 30 is provided more to the center of the toilet main body 2 in the left-right direction than the upstream end 36*a* of the water passage pipe 36 and the downstream end (the outlet 8*a*) of the water discharge pipe 8.

Figure 7:
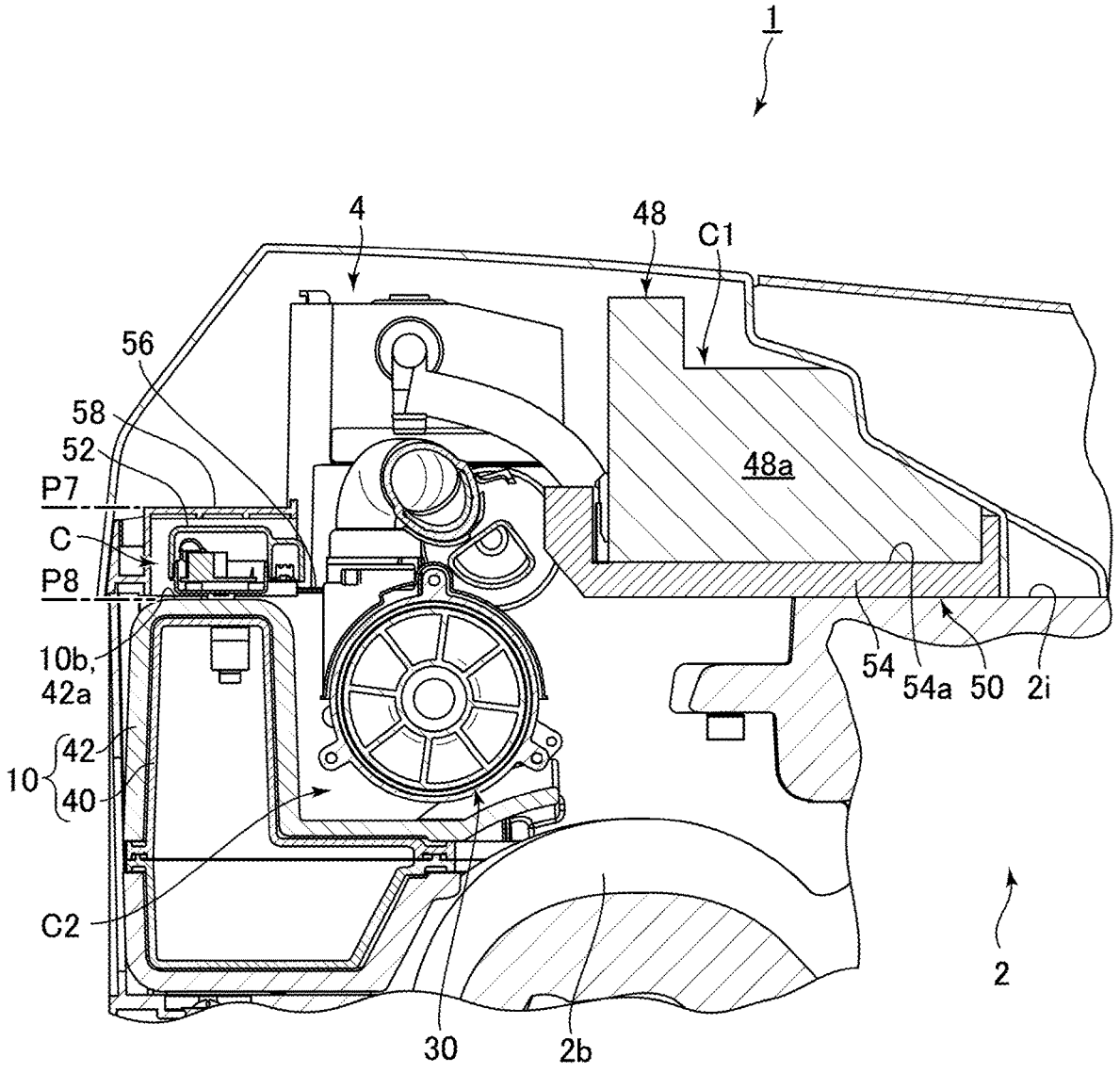
FIG. 7 is a cross-sectional side view showing a state where a private part washing device is provided on a rear upper surface of a toilet main body of the flush toilet according to the embodiment of the present disclosure.

Next, FIG. 7 is a cross-sectional side view showing a state where a private part washing device is provided on a rear upper surface of the toilet main body of the flush toilet according to the embodiment of the present disclosure.

As shown in FIG. 7, a private part washing device 48 of the flush toilet 1 according to the present embodiment is capable of washing private parts of a user, and is disposed on the upper surface 2*i* of the toilet main body 2, behind the bowl 2*a*, via a holding member (a holding plate 50).

Furthermore, as shown in FIGS. 3 and 7, the controller C is disposed on an outer upper surface 10*b* of the storage tank 10 (on an outer upper surface 42*a* of the antisweat material 42 of the storage tank 10).

Still further, as shown in FIGS. 3 and 7, an upper surface 52 (a position P7) of the controller C is located at a position higher than the upper surface 2*i* (a position P8) of the rim 2*c* of the toilet main body 2.

Additionally, as shown in FIG. 3, the present embodiment describes a case where the controller C is provided only on an outer upper surface of the rear small tank section 46*a* of the storage tank 10, but such a case is not restrictive, and the controller C may be provided extending over both the outer upper surface of the rear small tank section 46*a* and an outer upper surface of the rear large tank section 44*a* of the storage tank 10. Alternatively, the controller C may be provided only on the outer upper surface of the rear large tank section 44*a* of the storage tank 10.

Next, as shown in FIG. 7, the holding plate 50 is disposed on the upper surface 2*i* of the toilet main body 2, behind the bowl 2*a*.

Furthermore, as shown in FIG. 7, the holding plate 50 includes a front base 54 and a base (a rear base 56) behind the front base 54.

Moreover, as shown in FIG. 7, a private part washing-side housing region C1 where a functional unit 48*a* of the private part washing device 48 is housed is formed above the front base 54.

As shown in FIG. 7, a tank-side housing region C2 where the storage tank 10, the pump 30 and the like of the tank device 4 are housed is formed below the rear base 56.

Furthermore, as shown in FIG. 7, a cover portion (a cover portion 58), of the rear base 56, that covers a periphery of the controller C protrudes above a base surface 54*a* of the front base 54 (to the private part washing-side housing region C1 side) so that the controller C is housed in the tank-side housing region C2.

Next, an effect of the flush toilet 1 according to the embodiment of the present disclosure described above will be described with reference to FIGS. 1 to 7.

With the flush toilet 1 according to the present embodiment, the controller C is disposed on the outer upper surface 10*b* of the storage tank 10 behind the toilet main body 2. Accordingly, a limited space behind the toilet main body 2, above the storage tank 10 (an installation space, a dead space or the like), may be effectively used.

Accordingly, a dimension of the entire flush toilet 1 in the front-back direction and the left-right direction may be reduced and the size of the flush toilet 1 may be reduced while securing a capacity of the tank main body 40 of the storage tank 10 of the tank device 4.

Furthermore, because the controller C is disposed on the outer upper surface 10*b* of the storage tank 10 (the outer upper surface 42*a* of the antisweat material 42) blocking top of the storage tank 10, the controller C may be prevented from getting wet from flush water in the tank main body 40 of the storage tank 10.

Moreover, because the controller C is disposed on the outer upper surface 10*b* of the storage tank 10, the controller C is disposed at a position relatively higher than the entire tank device 4. Accordingly, an excessive weight load may be prevented from being applied to the controller C from the entire tank device 4.

As a result, reliability of the controller C may be secured.

Furthermore, the controller C above the storage tank 10 may be easily accessed from above at the time of maintenance or the like of the tank device 4, and the ease of work may be increased.

Next, with the flush toilet 1 according to the present embodiment, the upper surface 52 of the controller C is located at a position higher than the upper surface 2*i* of the rim 2*c* of the toilet main body 2.

Accordingly, even if flush water splashes from the bowl 2*a* of the toilet main body 2 onto the upper surface of the rim 2*c*, the risk of the entire controller C getting wet from the splashed flush water may be reduced. Accordingly, reliability of the controller C may be further increased.

Next, with the flush toilet 1 according to the present embodiment, the part (the cover portion 58), of the rear base 56 of the holding plate 50 for holding the private part washing device 48, surrounding the periphery of the controller C protrudes higher (on the private part washing-side housing region C1 side) than the base surface 54*a* of the front base 54.

Accordingly, the controller C may be housed in the tank-side housing region C2 while effectively using the limited dead space behind the toilet main body 2, above the storage tank 10.

Furthermore, the periphery of the controller C may be covered by the cover portion 58 of the rear base 56 of the holding plate 50.

The controller C may thereby be effectively prevented by the cover portion 58 of the rear base 56 of the holding plate 50 from getting wet from water leaking from the toilet main body 2 or the private part washing device 48, for example, even when the controller C that is disposed on the outer upper surface 10*b* of the storage tank 10 protrudes higher (to the private part washing-side housing region C1 side) than the base surface 54*a* of the front base 54 of the holding plate 50.

Moreover, the controller C is provided above the storage tank 10 and is protected by the cover portion 58 of the rear base 56 of the holding plate 50.

Accordingly, the controller C may be protected from external loads such as water, an excessive weight load from outside and the like, and reliability of the controller C may be further increased.

Next, with the flush toilet 1 according to the present embodiment, the storage tank 10 is disposed in a manner surrounding the upper part of the discharge trap pipe 2*b* from both the left and right sides and from behind.

Accordingly, the storage tank 10 may be disposed by effectively using the limited space behind the toilet main body 2.

Accordingly, the size of the entire flush toilet 1 may be reduced while securing a larger tank capacity for the tank main body 40 of the storage tank 10.

Next, with the flush toilet 1 according to the present embodiment, the storage tank 10 has a left-right asymmetrical shape by including the large tank section 44 and the small tank section 46, and thus, the storage tank 10 for which a larger tank capacity may be secured may be disposed by effectively using the limited space behind the toilet main body 2.

Next, with the flush toilet 1 according to the present embodiment, because the storage tank 10 has a left-right asymmetrical shape due to the rear large tank section 44*a*, the front large tank section 44*b* and the lower large tank section 44*c* of the large tank section 44 and the rear small tank section 46*a* and the front small tank section 46*b* of the small tank section 46, a larger tank capacity may be secured by effectively using the limited space behind the toilet main body 2, and also, the size of the entire flush toilet 1 may be reduced.

Furthermore, because the controller C is provided on the outer upper surface of the rear large tank section 44*a* and/or the outer upper surface of the rear small tank section 46*a* of the storage tank 10, the risk of the entire controller C getting wet may be reduced.

Moreover, the controller C on the outer upper surface of the rear large tank section 44*a* and/or the outer upper surface of the rear small tank section 46*a* of the storage tank 10 may be easily accessed from above at the time of maintenance or the like, and the ease of work may be further increased.

Next, with the flush toilet 1 according to the present embodiment, the pump 30 may be driven under control of the controller C while water is being supplied from the water supply pipe 6 to the storage tank 10, and flush water may be fed under pressure from the storage tank 10 to the toilet main body 2, and supply of water from the water supply pipe 6 to the storage tank 10 and supply of flush water by the pump 30 to the toilet main body 2 may be simultaneously performed.

This may reduce the risk of the water level in the tank main body 40 of the storage tank 10 rapidly rising and causing overflow of water during water supply, even if the tank capacity is limited because the storage tank 10 is disposed in the limited space behind the toilet main body 2.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet for flushing and discharging waste with flush water, the flush toilet comprising:

a toilet main body including a bowl configured to receive waste, a rim formed on a top edge of the bowl, and a discharge trap configured to discharge the waste in the bowl;

a tank device configured to supply flush water to the toilet main body, the tank device being provided behind the toilet main body; and a private part washing device configured to wash a private part of a user, the private part washing device being provided on a rear upper surface, of the toilet main body, behind the bowl, wherein the tank device includes a water supply part configured to supply flush water that is supplied from a water supply source, a storage tank configured to store the flush water supplied from the water supply part, the storage tank being located behind the private part washing device and above a floor surface, a pump configured to feed the flush water in the storage tank to the toilet main body, and a controller configured to control operation of the water supply part and the pump, and the controller is disposed on an outer upper surface of the storage tank and the controller is disposed behind the pump.

2. The flush toilet according to claim 1, wherein an upper surface of the controller is located at a position higher than an upper surface of the rim of the toilet main body.

3. The flush toilet according to claim 1, further comprising a holding member configured to hold the private part washing device, the holding member being disposed behind the bowl and on the rear upper surface of the toilet main body, wherein the holding member includes a front base above which a private part washing-side housing region for housing a functional unit of the private part washing device is formed, and a rear base below which a tank-side housing region for housing the storage tank is formed, the rear base being provided behind the front base, and in the rear base, a part configured to surround a periphery of the controller protrudes on a side of the private part washing-side housing region higher than a base surface of the front base so that the controller is housed in the tank-side housing region.

4. The flush toilet according to claim 1, wherein the discharge trap extends, in a plan view, in a front-back direction from an inlet connected to the bowl to an outlet behind the bowl, and the storage tank is disposed in a manner surrounding an upper part of the discharge trap from both left and right sides and from behind.

5. The flush toilet according to claim 1, wherein the storage tank has a left-right asymmetrical shape including a large tank section and a small tank section, the large tank section being a large-capacity side of the storage tank that is divided into two at a center in a left-right direction, the small tank section being a small-capacity side of the storage tank that is divided into two at the center in the left-right direction.

6. The flush toilet according to claim 5, wherein the large tank section includes a rear large tank section disposed behind the discharge trap, a front large tank section that extends forward from the rear large tank section and that is disposed on one of left and right sides of the discharge trap, and a lower large tank section extending downward from the rear large tank section, the small tank section includes a rear small tank section disposed behind the discharge trap, and a front small tank section that extends forward from the rear small tank section and that is disposed on another one of the left and right sides of the discharge trap, a front end of the front large tank section is disposed more forward than a front end of the front small tank section, a bottom surface of the lower large tank section is located at a position that is lower than a bottom surface of each of the rear small tank section and the front small tank section, and the controller is provided on an outer upper surface of the rear large tank section and/or an outer upper surface of the rear small tank section.

7. The flush toilet according to claim 1, wherein the controller is configured to control so as to drive the pump while water is being supplied from the water supply part to the storage tank.

* * * * *